US009212022B2

(12) United States Patent
Phero

(10) Patent No.: US 9,212,022 B2
(45) Date of Patent: Dec. 15, 2015

(54) MANDREL FOR STRETCH FILM ROLLS

(71) Applicant: Nelson Phero, Lititz, PA (US)

(72) Inventor: Nelson Phero, Lititz, PA (US)

( * ) Notice: Subject to any disclaimer, the term of this patent is extended or adjusted under 35 U.S.C. 154(b) by 166 days.

(21) Appl. No.: 14/076,177

(22) Filed: Nov. 9, 2013

(65) Prior Publication Data

US 2015/0129710 A1 May 14, 2015

(51) Int. Cl.
*B65H 75/24* (2006.01)

(52) U.S. Cl.
CPC ..... *B65H 75/242* (2013.01)

(58) Field of Classification Search
CPC ..... B65H 75/24; B65H 75/242
USPC ..... 242/572, 573, 573.1–573.2, 0.8
See application file for complete search history.

(56) References Cited

U.S. PATENT DOCUMENTS

| | | | | |
|---|---|---|---|---|
| 459,200 | A * | 9/1891 | Farnsworth | 242/573.2 |
| 4,307,851 | A * | 12/1981 | Dunaevsky et al. | 242/530.3 |
| 4,600,334 | A * | 7/1986 | Soussloff | 403/369 |
| 5,011,094 | A * | 4/1991 | Azuma | 242/573.1 |
| 7,543,426 | B1 | 6/2009 | Phero | |
| 2008/0072543 | A1 | 3/2008 | Watson | |
| 2009/0308968 | A1 | 12/2009 | Piotrowski | |

* cited by examiner

*Primary Examiner* — Sang Kim
(74) *Attorney, Agent, or Firm* — Steven O'Donnell

(57) ABSTRACT

An adjustable mandrel for use with cored, or coreless rolls of stretch film is disclosed. The mandrel comprises a cylindrical shaft and a sheath. The shaft and sheath each comprise slanted regions that slide against each other when the shaft is moved relative to the sheath, and this sliding movement causes the radial displacement of the sheath such that the mandrel expands to press against the inner surface of a roll of stretch film. The displaced sheath portions retract when the shaft and sheath are disengaged and can be moved from the roll and reused. The even pressure exerted by the mandrel across the roll prevents deformation of the roll and waste of the film.

2 Claims, 6 Drawing Sheets

MANDREL FOR STRETCH FILM ROLLS

CLAIM OF PRIORITY

Applicant claims priority to U.S. Provisional Patent Application 61/728,313, titled "Adjustable Reusable Mandrel Core Stretch Wrapper," and filed on Nov. 20, 2012.

FIELD OF THE INVENTION

The subject matter of this application relates to tools and apparatuses used to wrap stretch films around products to secure them in place for long term and short term storage, or for being moved or shipped. In particular, the disclosed tool holds a cored, or a coreless, roll of film via pressure exerted by an expandable mandrel inserted into the longitudinal center of the roll. The disclosed subject matter may be used with large, automatic and semi-automatic wrapping systems, such as those used to wrap entire pallets of products or with smaller, hand-held wrapping devices.

BACKGROUND

In the shipping and manufacturing industries, products are often stacked onto pallets for ease of movement. If these pallets are raised by a pallet jack or forklift for movement, the materials stacked on the pallets may fall unless somehow secured into place. This securing is commonly obtained by wrapping the full pallets with a stretch film. Stretch film is commonly available in two forms: a cored roll or a coreless roll. Cored rolls comprise a cardboard or similar tube around which the stretch film is rolled. Coreless rolls are processed without a center tube.

In use, these rolls of stretch film are secured on a device (an "application device") that can either be moved around a pallet, or remain stationary while a pallet is moved, so that the stretch film may be wrapped around the pallet. An issue with these application devices when used with coreless rolls is that it is difficult to properly secure the stretch film roll while applying the film and slippage may occur, causing damage to the inner surface of the roll and cause the stretch film to disperse unevenly and to cause waste. Current stretch wrap application devices do not allow the full potential of coreless stretch film roll to be utilized.

As it exists on the roll, or as it is loosely unfurled, the stretch film is in it's unstretched state. When used to initially wrap products, the film is pulled taut and a modest amount of stretch is achieved, ensuring the wrapped items are held in place by the film. When the the products are adequately wrapped, the film is finally stretched to secure the film to itself so that it does not easily unroll from the products.

Most currently available application devices secure stretch film rolls by compressing them from the ends, and particularly in coreless rolls, this can cause tears in the film, loss of tension in the roll as it is unfurled, and slippage. Attempts to apply a force from within coreless stretch film rolls often result in snagging and tearing of the film. Each of these problems results in stretch film waste. Easyfix, a commercial application device available in New Zealand, comprises a post having retractable ridges which may be inserted into a coreless stretch film roll. These same ridges may distort the roll and may snag the inner surface of the coreless stretch film roll causing tearing and film waste.

SUMMARY

The subject matter of this application pertains to a device for applying stretch films and wraps comprising an adjustable mandrel that may be inserted into a cored or coreless roll of stretch film. The mandrel is tubular and can be expanded radially by a user so that the outer surface of the mandrel evenly expands across it's length. When expanded, the mandrel contacts the inner surface of the roll of stretch film and securely holds it. The outer surface of the mandrel is free of protrusions, and since it expands evenly across it's length, the proper use of the mandrel minimizes the risk of damage to the inner surface of the roll. The equal pressure applied by the mandrel across the entirety of the inner surface of the stretch film roll also allows the film to be stretched to a greater degree than can be accomplished by other application devices without damaging or distorting the roll.

The adjustable mandrel may be added to certain existing large application devices such as those suited for wrapping large amounts of products or smaller handheld application devices. Ideally, the entire application device is designed to take full advantage of the adjustable mandrel. Accordingly, an optimal application device would be comprised of inter alia, the adjustable mandrel, an adjustable tensioner, a film protector, and an adjustable brake system. Together, the application device would allow for optimal stretch of the film as it is tautly wrapped around the products to be secured, and increase the degree of stretch obtained when the film is pulled tight.

Use of the subject matter of this application reduces waste caused by damage to the stretch film rolls caused by other application devices that may damage the inner surface of the roll, or that compress and distort the roll by unevenly applying pressure to secure the roll. Use of the subject matter of this application further allows a user to obtain greater stretch during the final securing phases of stretch wrap usage without damaging the roll of stretch film, allowing a roll of stretch film to wrap more products than would be possible with other stretch film application devices.

DETAILED DESCRIPTION OF THE PREFERRED EMBODIMENTS

Figure 1:
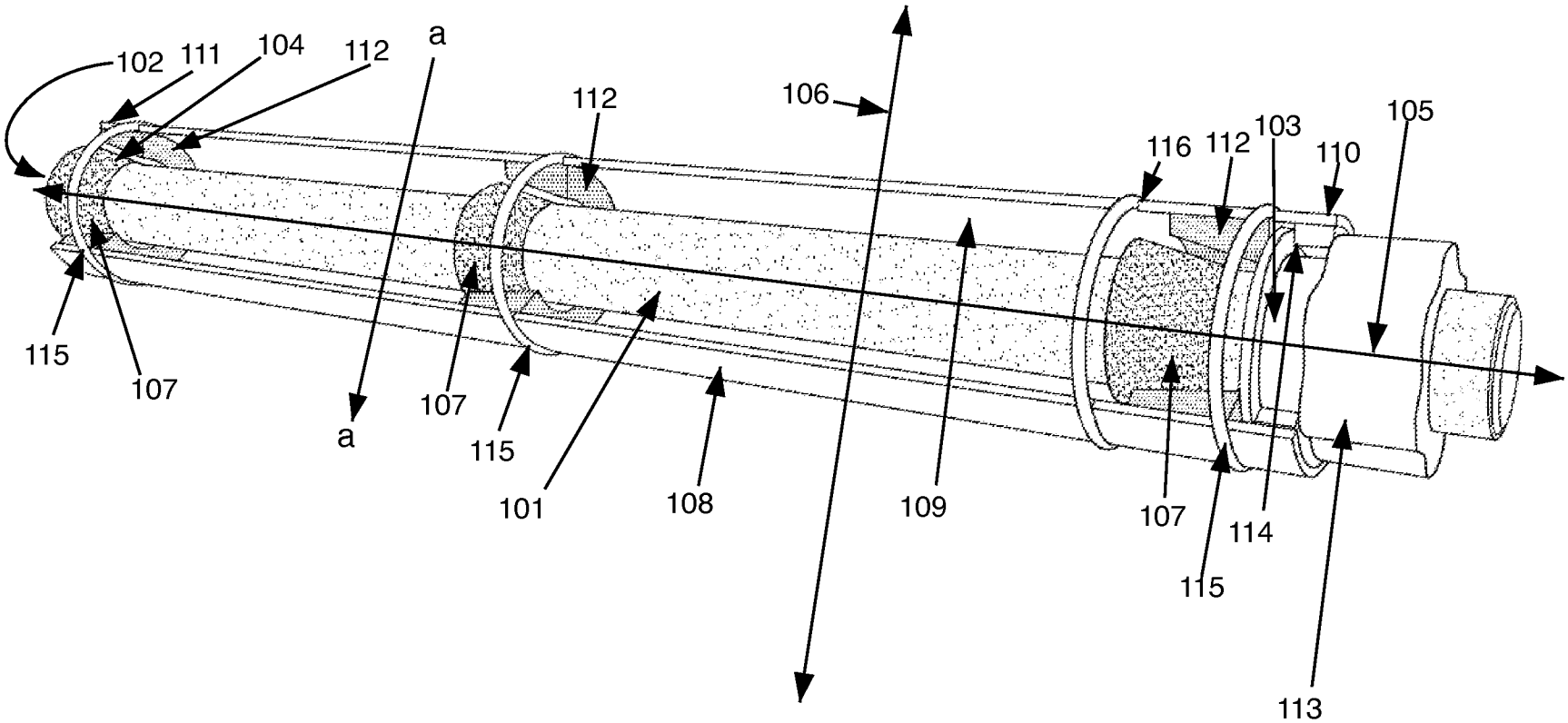
FIG. 1 is a perspective illustration of the mandrel in its smallest diameter conformation with a portion of the outer sheath removed to show the inner design.

The following description and drawings referenced therein illustrate embodiments of the application's subject matter. They are not intended to limit the scope. Those familiar with the art will recognize that other embodiments of the disclosed method are possible. All such alternative embodiments should be considered within the scope of the application's claims.

Each reference number consists of three digits. The first digit corresponds to the figure number in which that reference number is first shown. Reference numbers are not necessarily discussed in the order of their appearance in the figures.

This application discloses a novel adjustable mandrel suitable for use in devices used to apply stretch film from cored, and coreless rolls. The mandrel exerts force against the inner surface of stretch film rolls. This force is evenly distributed across the length of the mandrel and does not unevenly compress film rolls or damage the inner surface of the rolls as do other application devices. The subject matter of this application is of particular benefit when used with coreless stretch film rolls.

The mandrel comprises a predominantly cylindrical shaft and a sheath.

The tubular shaft comprises an outer face (101), an inner face (102), a first end (103), and a second end (104). Further, the shaft has a longitudinal axis (105) and a radial axis (106) transverse to the longitudinal axis. The inner face is of sufficient diameter to accept a main shaft pole (501) to allow for the reversible attachment of the mandrel to an attachment device. The shaft further comprises at least two inclined plane segments (107) on its outer face. In preferred embodiments, these inclined plane segments are roughly equally spaced along the length of the shaft.

The sheath surrounds the tubular shaft and comprises an outer face (108), an inner face (109), a first end (110), and a second end (111). Further, the sheath has a longitudinal axis (105) and a radial axis (106) transverse to the longitudinal axis. The sheath's longitudinal and radial axes are positioned the same as the shaft's longitudinal and radial axes. The sheath is sectioned into at least two two portions along the length of the sheath's longitudinal axis. In preferred embodiments, the sheath is sectioned into three or more portions (301) along the sheath's longitudinal axis.

Figure 2:
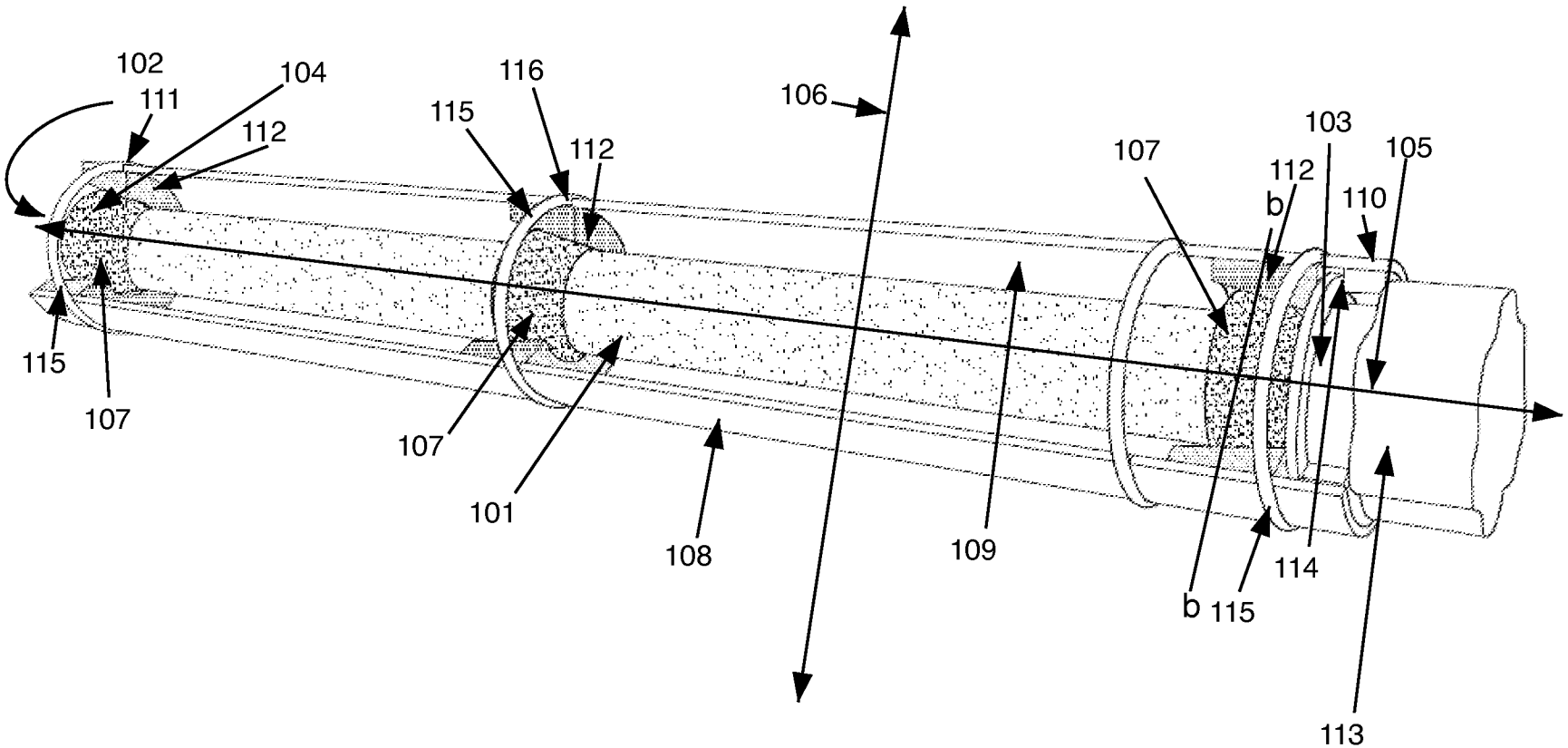
FIG. 2 is a perspective illustration of the mandrel in it's largest diameter conformation with a portion of the outer sheath removed to show the inner design.
Figure 4:
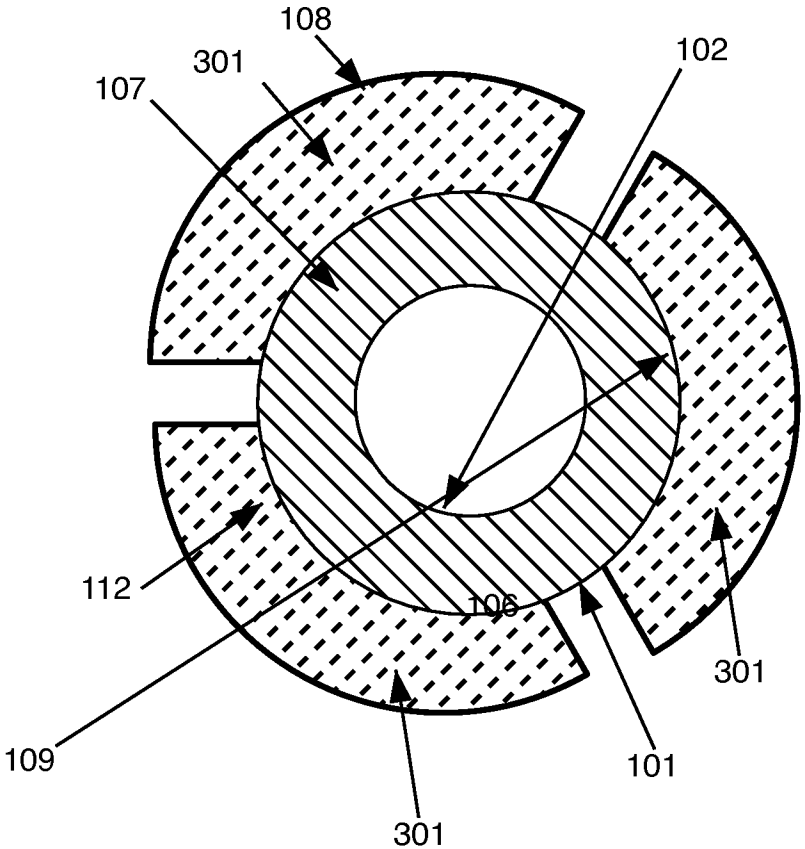
FIG. 4 is a transverse cross-section of the mandrel in its largest diameter conformation taken at reference section b-b of FIG. 2.
Figure 3:
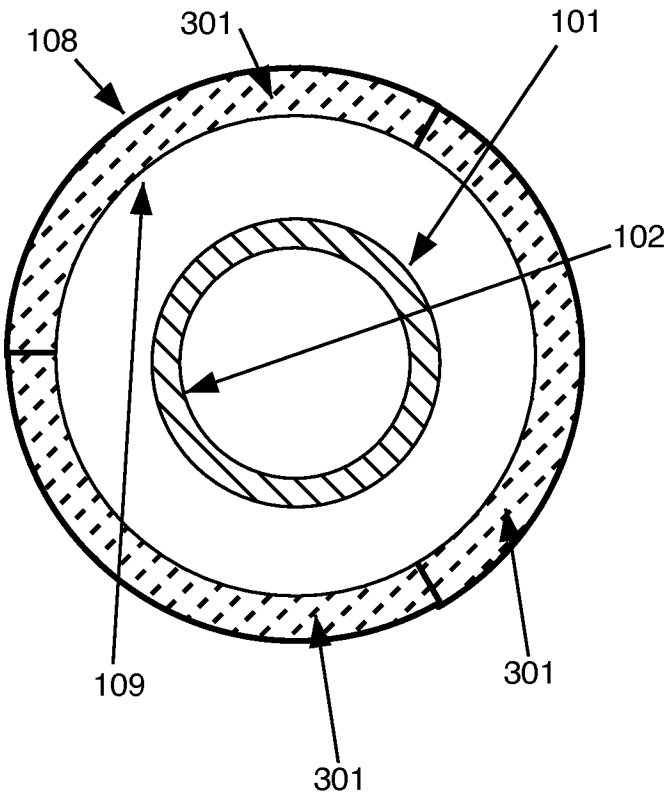
FIG. 3 is a transverse cross-section of the mandrel in its smallest diameter conformation taken at reference section a-a of FIG. 1.
Figure 5:
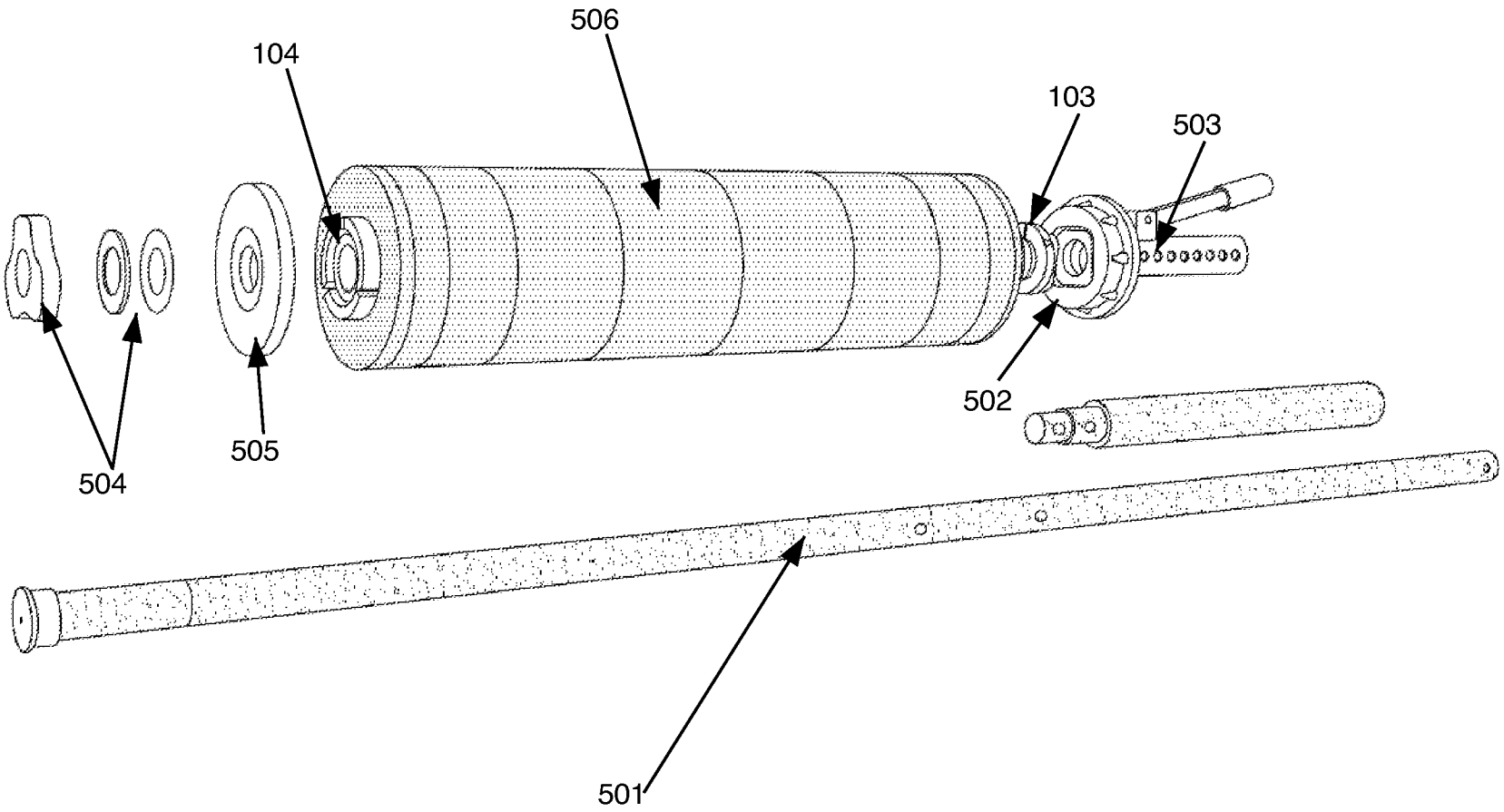
FIG. 5 is an exploded view of an application device comprising, inter alia, the disclosed mandrel.
Figure 6:
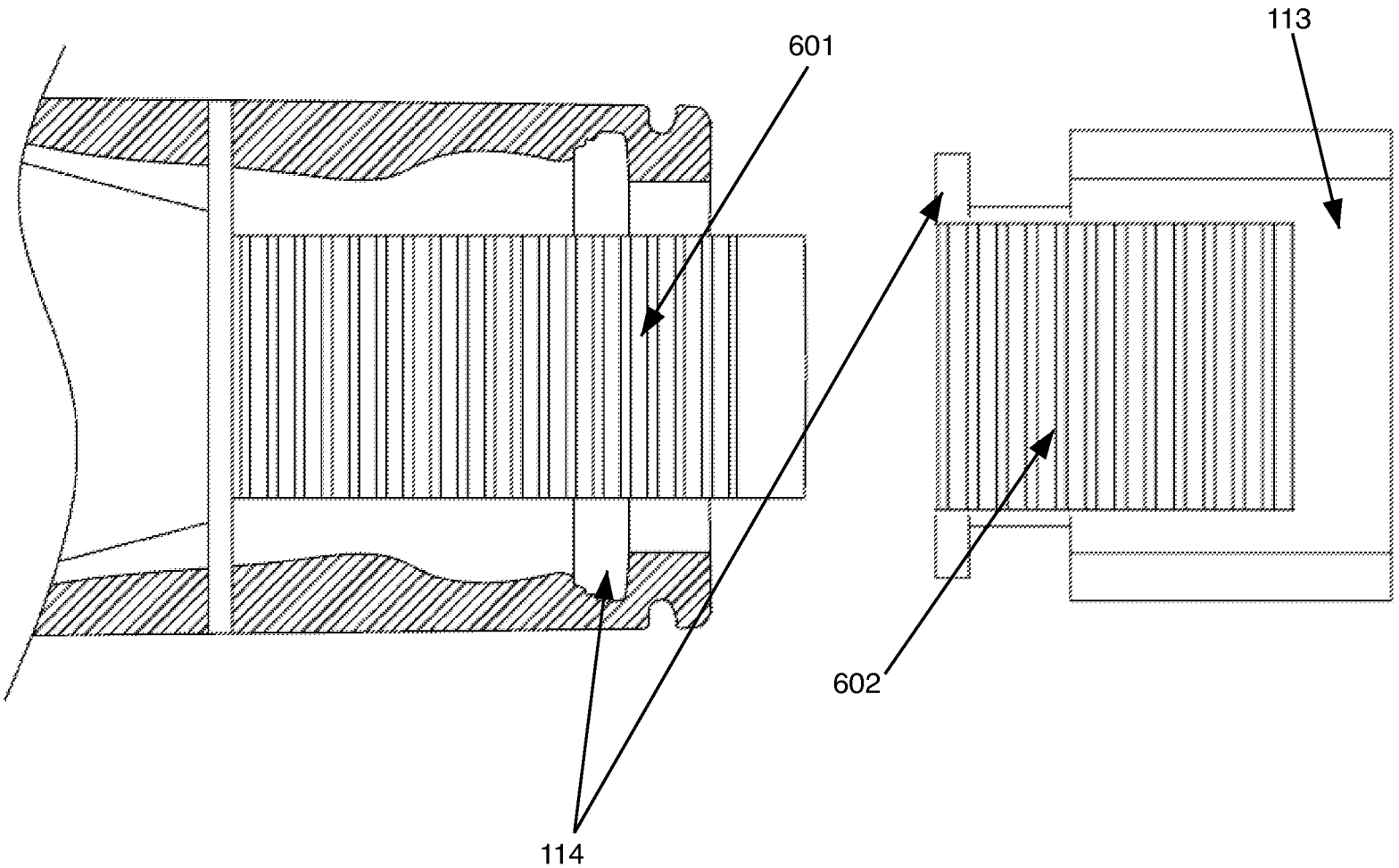
FIG. 6 is an exploded, longitudinal section of the end of the mandrel comprising an adjustment means.

Each portion of the sheath further comprises at least two slanted inclined plane segments (112) corresponding to the shaft's slanted inclined plane segments (107) so that when the sheath and shaft move relative to each other along the mandrel's longitudinal axis the portions of the sheath are radially displaced, thereby increasing or decreasing the diameter of the sheath. The diameter of the sheath can be adjusted to any value between the sheath's smallest (FIGS. 1 and 3) and largest diameter (FIGS. 2 and 4) conformations so that a wide range of stretch rolls can be used with the mandrel. In a preferred embodiment, when the sheath is in its smallest diameter conformation the sheath's portions are in contact with each other, however, gaps may exist between the sheath's portions even within the smallest diameter conformation. The presence of such a gap or gaps should not be construed to limit the claims. "Largely in contact" and related terms should be understood to encompass actual contact and any such gaps that do not alter the function of the disclosed subject matter of this application.

The mandrel further comprises an adjustment means (113) that operates to control the relative movement of the shaft and mandrel. In a preferred embodiment, the shaft's first end (103) comprises male threads (601) corresponding to female threads (602) that partially comprise the said adjustment means. In this preferred embodiment, the adjustment means holds the mandrel sheath's first end in place via a tongue and groove type connector (114) and rotation of the adjustment means causes the mandrel's shaft be either drawn into the adjustment means, or away from the adjustment means.

The mandrel further comprises at least two tension means (115) that constrict the movement of the sheath's portions from the shaft and cause the sheath's portions to retract when the sheath's, and the shaft's, inclined plane segments are disengaged. In a preferred embodiment, these tension rings are O-rings which are located in groves in the outer face of the tubular shaft (116).

In use, the mandrel, typically in it's smallest diameter conformation, is positioned in the center of a cored, or coreless, roll of stretch film. The position of the mandrel relative to the roll can be adjusted to correspond to the desired coverage height. The user then would manipulate the adjustment means to increase the diameter of the mandrel so that a firm and even pressure is exerted by the mandrel on the inner surface of the roll of stretch film. The mandrel may be placed over the main shaft pole (501) of an application device before, or after, it's association with a stretch film roll (506). This main shaft pole may comprise part of a mobile or stationary application device (FIG. 7) as the user requires.

Figure 7:
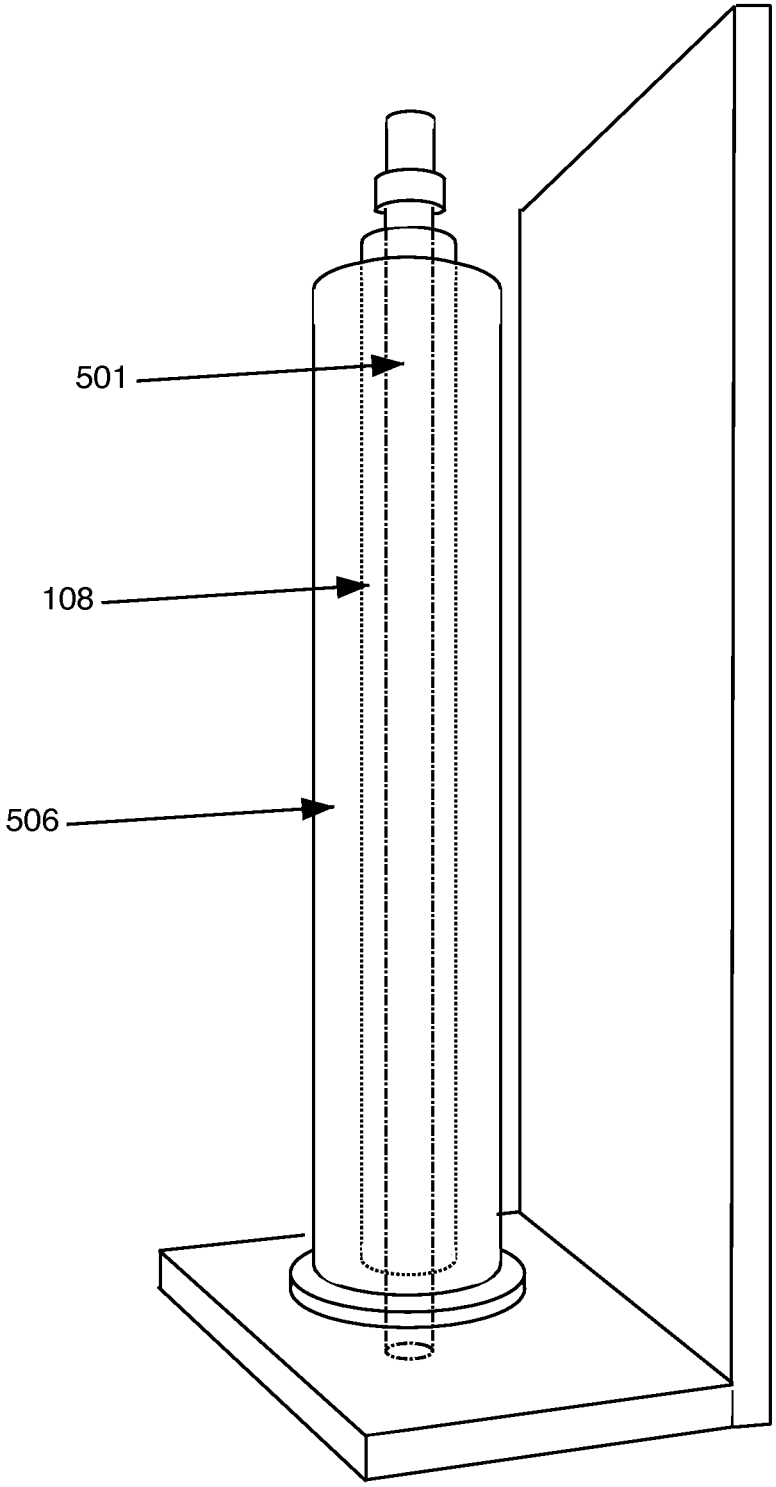
FIG. 7 is an illustration of the disclosed mandrel, supporting a roll of stretch film, and comprising part of a stationary application device.

In many preferred embodiments, the mandrel is a component of a complete application device. In one such embodiment, the application device further comprises an end cap (502) capable of engaging the mandrel's adjustment means and locking it into position. Most complete devices would also comprise a brake system (503) such as that disclosed in U.S. Pat. No. 7,543,426. Further, the complete device may comprise an adjustable tensioning system (504) which can adjust the height of the film in relation to the floor to accommodate differences between the floor and the height of the pallet so that the pallet and load are both wrapped by the stretch film. The tensioner system can also control the speed of the stretch film's release. A bottom floor wheel (505) may also be included in a complete application device to protect the bottom of the stretch film from from being damaged as it hits the floor. In other useful embodiments, the mandrel may be mounted on a main shaft pole as part of a stationary application device (FIG. 7).

Certainly, different designs of a complete application device, including other stationary or movable large floor models, as well as small handheld application devices, may benefit from the use of the disclosed subject matter. Therefore, the discussion of the complete application device above should not be construed to limit the claims to only that style of application device comprising the disclosed mandrel.

I claim:

1. An adjustable mandrel for securing a rolls of material from the inner surface of said roll, the adjustable mandrel having an open conformation and a closed conformation, and comprising a cylindrical shaft, a sheath surrounding said cylindrical shaft, and at least two tension means for restricting movement of the sheath, a. said cylindrical shaft comprising
   i. an outer face, an inner face, a first end, and a second end, said cylindrical shaft also comprising a longitudinal axis and a radial axis transverse to the cylindrical shaft's longitudinal axis,
   ii. said outer face further comprising
      1. at least two raised inclined plane segments, each said inclined plane segment having a slope, b. said sheath composed of at least two sections of predominantly equal diameter circular arcs and comprising
   i. an outer face, an inner face, a first end, and a second end, said sheath also comprising a longitudinal axis parallel to the cylindrical shaft's longitudinal axis and a radial axis transverse to the longitudinal axis and parallel to the cylindrical shaft's radial axis,
   ii. the sheath's inner face further comprising
      1. at least two raised inclined plane segments, each said inclined plane segment having a slope, said slopes being complimentary to the cylindrical shaft's outer face's inclined plane slopes so that as the shaft's inclined planes slide against the cylindrical shaft's inclined planes the sheath's sections are displaced along the sheath's radial axis, c. said tension means capable of constricting the radial movement of the sheath's sections and causing these sections to retract along the sheath's radial axis towards the cylindrical shaft when the sheath's inclined plane segments are separated from the corresponding inclined plane segments located on the cylindrical shaft, thereby placing the mandrel in its closed conformation, d. the tension means further being able to stretch in response to the movement of the sheath's sections being moved away from the cylindrical shaft along the sheath's radial axis.

2. An adjustable mandrel for securing a rolls of material from the inner surface of said roll, the adjustable mandrel having an open conformation and a closed conformation, and comprising a cylindrical shaft, a sheath surrounding said cylindrical shaft, and at least two tension means for restricting movement of the sheath, a. said cylindrical shaft comprising i. an outer face, an inner face, a first end, and a second end, said cylindrical shaft also having a longitudinal axis and a radial axis transverse to the cylindrical shaft's longitudinal axis, ii. said outer face further comprising 1. at least two raised inclined plane segments, each said inclined plane segment having a slope, b. said sheath composed of at least two sections of predominantly equal diameter circular arcs and comprising i. an outer face, an inner face, a first end, and a second end, said sheath also comprising a longitudinal axis parallel to the cylindrical shaft's longitudinal axis and a radial axis transverse to the longitudinal axis and parallel to the cylindrical shaft's radial axis, ii. the sheath's inner face further comprising 1. at least two raised inclined plane segments, each said inclined plane segment having a slope, said slopes being complimentary to the cylindrical shaft's outer face's inclined plane slopes so that as the shaft's inclined planes slide against the cylindrical shaft's inclined planes the sheath's sections are displaced along the sheath's radial axis, c. said tension means comprising rubber O-rings surrounding the sheath's outer face and capable of constricting the radial movement of the sheath's sections and causing these sections to retract along the sheath's radial axis towards the cylindrical shaft when the sheath's inclined plane segments are separated from the corresponding inclined plane segments located on the cylindrical shaft, thereby placing the mandrel in its closed conformation.

d. the tension means further being able to stretch in response to the movement of the sheath's sections being moved away from the cylindrical shaft along the sheath's radial axis.

* * * * *